United States Patent [19]

Rossman

[11] Patent Number: 4,773,331

[45] Date of Patent: Sep. 27, 1988

[54] CONNECTION ARRANGEMENT BETWEEN A SABOT JACKET AND THE SABOT REAR PORTION OF A SABOT PROJECTILE

[75] Inventor: Rudolf Rossman, Zurich, Switzerland

[73] Assignee: Werkzeugmaschinenfabrik Oerlikon-Bührle AG, Zurich, Switzerland

[21] Appl. No.: 400,618

[22] Filed: Jul. 22, 1982

[30] Foreign Application Priority Data

Aug. 13, 1981 [CH] Switzerland ..... 5210/81

[51] Int. Cl.[4] ..... F42B 13/16

[52] U.S. Cl. ..... 102/520; 102/523

[58] Field of Search ..... 102/501, 513, 520, 521, 102/522, 523, 524, 525, 526, 527, 528, 529

[56] References Cited

U.S. PATENT DOCUMENTS 3,927,618 8/1975 Engel ..... 102/522

*Primary Examiner*—Harold J. Tudor

*Attorney, Agent, or Firm*—Werner W. Kleeman

[57] ABSTRACT

Increasingly greater requirements as concerns mechanical strength and gas tightness are placed upon the connection between the sabot tail or rear portion and the sabot jacket of a sabot projectile. To improve such connection the invention provides a circumferential groove at the sabot tail or rear portion, this circumferential groove having side walls extending essentially parallel to one another and inclined forwardly with respect to the lengthwise axis of the projectile at an angle of about 75°. The rear end of the sabot jacket protrudes into such circumferential groove.

3 Claims, 1 Drawing Sheet

CONNECTION ARRANGEMENT BETWEEN A SABOT JACKET AND THE SABOT REAR PORTION OF A SABOT PROJECTILE

BACKGROUND OF THE INVENTION

The present invention relates to a new and improved connection arrangement between the sabot jacket and the sabot tail or rear portion of a sabot projectile.

In its more specific aspect the invention is directed to a new and improved connection between the sabot jacket and the sabot tail or rear portion of a sabot projectile containing a circumferential groove at the sabot tail portion into which protrudes a flange of the sabot jacket, in order to form a connection between the sabot jacket and the sabot tail portion which, on the one hand, withstands the mechanical forces upon firing of the sabot projectile and, on the other hand, is gastight.

According to a state-of-the-art sabot projectile of this type as disclosed, for instance, in U.S. Pat. No. 4,249,466, granted Feb. 10, 1981 and the cognate Swiss Pat. No. 622,833, granted Apr. 30, 1981, the connection between the sabot jacket and the sabot tail or rear portion is configured in such a manner that in the presence of large mechanical forces and appreciable gas pressure there nonetheless exists the danger that the sabot jacket, during firing of the projectile, will prematurely detach from the sabot, or that the connection will not be capable of withstanding the large gas pressure, i.e. is not sufficiently gastight. When the firing weapon fires at a greater firing cadence appreciable acceleration and deceleration forces arise during the infeed of the cartridges to the weapon. Consequently, the danger exists that the connection between the sabot tail portion and the sabot jacket already will become damaged prior to infeed of the projectile into the weapon. The cartridge casing is secured at a circumferential groove of the projectile or at the sabot tail or rear portion, respectively. The deeper that this circumferential groove is that much greater are the forces required for the ejection of the projectile out of the cartridge casing, and thus, the greater the gas pressure at the instant when the projectile exits from the cartridge casing. Therefore, increased requirements are placed upon the gastight connection between the sabot jacket and the sabot tail or rear portion.

In particular, this connection is endangered as long as the projectile, following the ignition of the propellant charge in the cartridge casing, moves through the free flight path and the rotating or guide band is not yet supported at its outer surface upon the weapon barrel wall and the rifling. In the weapon barrel itself the rotating band is pressed against the sabot tail or rear portion.

SUMMARY OF THE INVENTION

Therefore, with the foregoing in mind it is a primary object of the present invention to provide an improved connection arrangement between the sabot jacket and the sabot tail or rear portion of a sabot projectile.

Another and more specific object of the present invention aims at providing an improved connection between the sabot jacket and the sabot tail portion, in a manner such that such connection is capable of withstanding large mechanical forces and large gas pressure upon firing of the sabot projectile.

Now in order to implement these and still further objects of the invention, which will become more readily apparent as the description proceeds, the connection arrangement between the sabot jacket and the sabot tail portion of a sabot projectile, as contemplated by the invention, is manifested by the features that the sabot tail or rear portion, apart from being provided with the aforementioned circumferential groove, possesses a second or additional circumferential groove, and that the sabot jacket, apart from containing the aforementioned flange, possesses a second or additional flange, wherein the first flange serves for sealing purposes and the second flange for attachment purposes.

Preferably, the side walls of the one circumferential groove are parallel to one another and inclined forwardly at an angle of about 75° with respect to the lengthwise axis of the projectile. The side walls of the other or second circumferential groove are preferably respectively forwardly and rearwardly inclined in relation to the projectile axis through an angle of about 75°.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
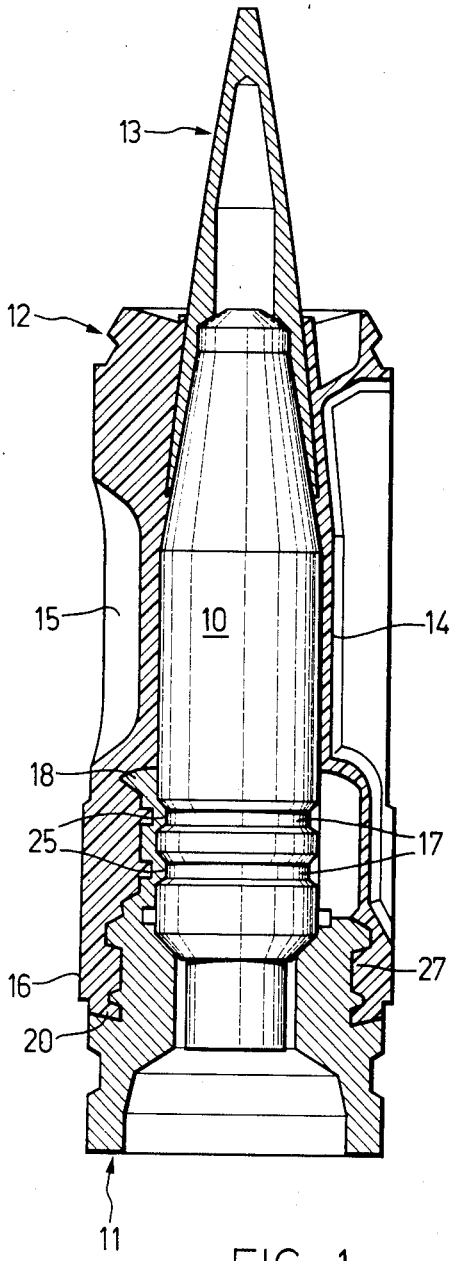
FIG. 1 is a longitudinal sectional view through a sabot projectile constructed according to the invention.
Figure 2:
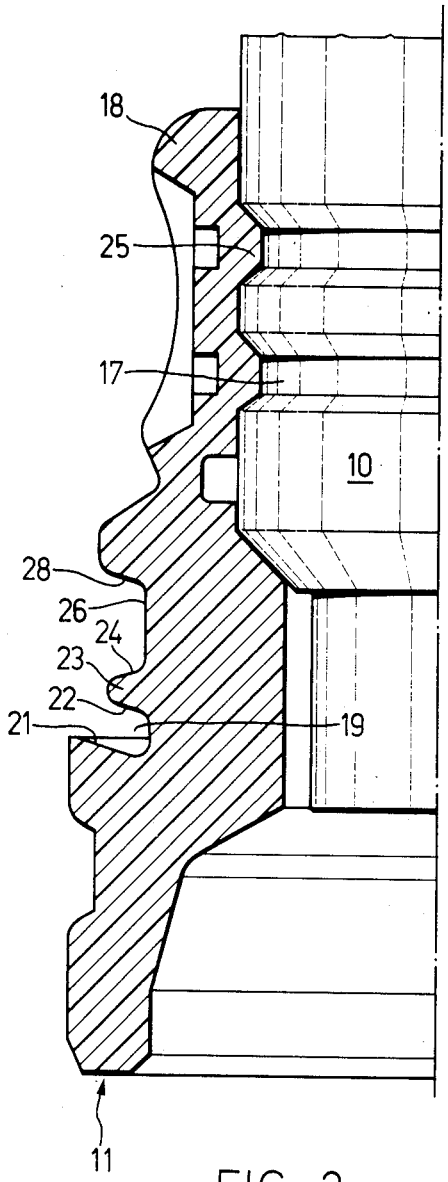
FIG. 2 is an enlarged detail showing of a part of the sabot tail or rear portion of the sabot projectile depicted in FIG. 1.

Describing now the drawings, by referring to FIG. 1 there will be recognized that an exemplary embodiment of sabot projectile constructed according to the invention comprises a projectile body 10, a sabot tail or rear portion 11 and a sabot jacket 12. Mounted upon the projectile body 10 is a ballistic hood 13. A hard metal alloy or a tungsten alloy can be beneficially used, as is well known in the ordnance arts, for fabricating the projectile body 10. The sabot tail portion 11 is manufactured, for instance, from a light metal and the sabot jacket 12 is fabricated, for instance, from a suitable plastics material. The sabot jacket 12 usually consists of three segments which are interconnected with one another by means of suitable reference fracture locations 14. In the drawing of FIG. 1 there is only visible one of these reference fracture locations 14. Additionally, the sabot jacket 12 possesses recesses 15 and a guide band 16. The projectile body 10 possesses two circumferential grooves 17 which serve for the attachment of the sabot tail or rear portion 11. This sabot tail portion 11 is provfided with, for instance, six tongue members 18 which protrude by means of protruberances or dogs 25 or equivalent structure into the circumferential grooves 17 of the projectile body 10.

The heretofore described construction of the sabot projectile is known as such. As will be recalled, the invention is specifically concerned with a novel connection arrangement between the sabot jacket 12 and the sabot tail or rear portion 11.

As stated, increasing requirements are placed upon such connection because of the greater firing cadence of the weapons system. As also explained, due to the higher withdrawal resistance the gas pressure becomes greater upon exit of the projectile out of the cartridge casing. With increased infeed speed or velocity of the cartridges to the firing weapon there is present an increased mechanical loading of the connection between the sabot jacket 12 and the sabot tail or rear portion 11. By appropriately constructing such connection or connection arrangement it is contemplated, according to the invention, to prevent that propellant gases will penetrate between the sabot jacket 12 and the sabot tail portion 11.

For this purpose the sabot tail or rear portion 11 possesses a first circumferential groove 19 which is formed and bounded by two essentially mutually parallel side walls 21 and 22. These side walls 21 and 22 are inclined forwardly at an angle of about 75° with respect to the lengthwise axis of the projectile. Furthermore, there is provided a second circumferential groove 26 which is formed by two side walls 24 and 28, wherein the one side wall 24 is inclined rearwardly at an angle of about 75° and the other side wall 28 is inclined forwardly through the same angle of about 75°. A circumferential rib member 23 separates both of the circumferential grooves 19 and 26 from one another.

By virtue of the provision of the first circumferential groove 19 there is obtained a reliable gastight connection, and through the provision of the second circumferential groove 26 there is obtained a reliable connection or attachment capable of withstanding the mechanical forces.

Protruding into the first circumferential groove 19 is an appropriately configured first flange or flange member 20 of the sabot jacket 12, and protruding into the second circumferential groove 26 is an appropriately configured second flange or flange member 27 of the sabot jacket 12.

It is not absolutely necessary that the side walls 21, 22 and 24, 28 of the circumferential grooves 19 and 26, respectively, be inclined. They also could be oriented essentially perpendicular to the projectile axis. Equally, it is conceivable to use wedge-shaped or dovetail-shaped circumferentially extending grooves.

While there are shown and described present preferred embodiments of the invention, it is to be distinctly understood that the invention is not limited thereto, but may be otherwise variously embodied and practiced within the scope of the following claims.

Accordingly, what I claim is:

1. A connection arrangement between a sabot jacket and a sabot tail portion of a sabot projectile having a lengthwise axis, comprising:

a sabot tail portion having an outer surface and having, as viewed in a forward direction from a rear part towards a front part thereof, a first circumferential groove on said outer surface thereof;

a sabot jacket provided with a first flange member protruding into said first circumferential groove;

said sabot tail portion, as viewed in said forward direction, having a second circumferential groove on said outer surface thereof;

a first end which defines a rear end of the connection arrangement;

said first and said second circumferential grooves being formed in said outer surface of said sabot tail portion at said first end of the connection arrangement;

said sabot jacket possessing a second flange member protruding into said second circumferential groove;

said first flange member essentially serving for sealing purposes and said second flange member essentially serving for attachment purposes; and said first circumferential groove contains bounding said walls which are essentially mutually parallel to one another and are forwardly inclined at an angle of about 75° with respect to the lengthwise axis of the sabot projectile.

2. The connection arrangement as defined in claim 1, wherein:

said second circumferential groove is bounded by a pair of side walls which are inclined outwardly away from each other at an angle of about 75° with respect to the lengthwise axis of the sabot projectile.

3. A connection arrangement between a sabot jacket and a sabot tail portion of a sabot projectile having a lengthwise axis, comprising:

a sabot tail portion having an outer surface and having, as viewed in a forward direction from a rear part towards a front part thereof, a first circumferential groove on said outer surface thereof;

said first circumferential groove containing bounding side walls which are essentially mutually parallel to one another and are forwardly inclined at an angle of about 75° with respect to the lengthwise axis of the sabot projectile;

a sabot jacket provided with a first flange member protruding into said first circumferential groove;

said sabot tail portion having, as viewed in said forward direction, a second circumferential groove on said outer surface thereof;

said second circumferential groove being bounded by a pair of side walls which are inclined outwardly away from each other at an angle of about 75° with respect to the lengthwise axis of the sabot projectile;

a circumferential rib member separating both of said circumferential grooves from one another;

a first end which defines a rear end of the connection arrangement;

said first and said second circumferential grooves being formed in said outer surface of said sabot tail portion at said first end of the connection arrangement;

said sabot jacket possessing a second flange member protruding into said second circumferential groove; and said first flange member essentially serving for sealing purposes and said second flange member essentially serving for attachment purposes.

* * * * *